United States Patent [19]

Kawaguchi et al.

[11] Patent Number: 4,537,567

[45] Date of Patent: Aug. 27, 1985

[54] ROLLING PISTON TYPE COMPRESSOR

[75] Inventors: Susumu Kawaguchi, Shizuoka; Ken Morinushi, Kobe, both of Japan

[73] Assignee: Mitsubishi Denki Kabushiki Kaisha, Tokyo, Japan

[21] Appl. No.: 552,026

[22] Filed: Nov. 15, 1983

[30] Foreign Application Priority Data

Nov. 29, 1982 [JP] Japan ..... 57-208771
Feb. 2, 1983 [JP] Japan ..... 58-15796

[51] Int. Cl.[3] ..... F04C 29/00
[52] U.S. Cl. ..... 418/63; 418/180
[58] Field of Search ..... 418/189, 180, 63, 64, 418/65, 66, 67

[56] References Cited

U.S. PATENT DOCUMENTS 2,155,756 4/1939 Firestone et al. ..... 418/180 X

FOREIGN PATENT DOCUMENTS 861849 1/1953 Fed. Rep. of Germany ..... 418/63
57-41493 3/1982 Japan ..... 418/63
2092674 8/1982 United Kingdom ..... 418/180

*Primary Examiner*—Richard E. Gluck
*Attorney, Agent, or Firm*—Oblon, Fisher, Spivak, McClelland & Maier

[57] ABSTRACT

A rolling piston type compressor comprises a cylinder; a piston eccentrically rotating along the inner peripheral surface of the cylinder; a vane which is in contact with the outer peripheral surface of the piston, performs reciprocating movement therealong, and defines the cylinder interior into a low pressure chamber and a high pressure chamber; a discharge port to discharge compressed gas outside the cylinder; a discharge valve provided in the discharge port; and an escape groove formed in the inner peripheral wall of the cylinder and extending in the direction opposite to the rotational direction of the piston with respect to the discharge port.

4 Claims, 13 Drawing Figures

ROLLING PISTON TYPE COMPRESSOR

BACKGROUND OF THE INVENTION

1. Field of the Invention

This invention relates to a rolling piston type compressor which serves to suppress noise to the maximum possible extent.

2. Description of the Prior Art

In general, the rolling piston type compressor performs its compression operation upon each revolution of the piston. However, as the rolling piston increases its speed to result in a high compression ratio, a high pressure gas in the vicinity of a space in a discharge port and a low pressure gas within a low pressure chamber of the cylinder are instantaneously brought into communication condition, when the piston is about to pass by the discharge port, with the consequence being that a shock wave is produced in a low pressure chamber interior in the same way as when a diaphragm which divides a shock tube into a high pressure side and a low pressure side is broken the pressure pulse of which vibrates the cylinder, piston and other components of the compressor to cause a steep rise in noise level.

SUMMARY OF THE INVENTION

The present invention has been made with a view to eliminating the above mentioned problem, and aims at providing an improved structure in the rolling piston type compressor.

It is another object of the present invention to provide an improved rolling piston type compressor, wherein an escape groove is formed in one part of an inner peripheral wall of the cylinder to make it possible to gradually communicate the high pressure chamber with the low pressure chamber through the groove, suppressing the intensity of the shock wave, and thereby minimizing the pressure pulse.

It is still another object of the present invention to provide an improved rolling piston type compressor, wherein an escape groove is formed in a wall surface of the discharge port or in another wall surface contiguous to the wall surface of the discharge port at an upstream side of the crank angle from the discharge port to thereby enable the high pressure gas in the vicinity of the space in the discharge port to be communicated with the low pressure chamber of the cylinder, thereby suppressing the noise due to the shock wave to the minimum possible extent.

It is other object of the present invention to provide an improved rolling piston type compressor, wherein an escape groove is formed in the inner peripheral wall of the cylinder in a manner to be communicative with the discharge port, the escape groove being formed to have smooth mirror surface in such a manner that it has a length of from 1.5 to 4 times the diameter of the above-mentioned discharge port. In addition, the maximum depth of the escape groove is in the range of from approximately 5% to 25% of the diameter of the discharge port.

It is still other object of the present invention to provide an improved rolling piston type compressor, wherein an escape groove is formed in the inner peripheral wall of the cylinder at a position independent of the discharge port, the length of the escape groove being substantially equal to, and as much as 4 times as large as the diameter of the discharge port in a direction opposite to the rotational direction of the piston from the center of the open surface of the discharge port. Its maximum depth is approximately 5% to 25% of the diameter of the discharge port.

According to the present invention, in general aspect of it, there is provided a rolling piston type compressor which comprises in combination: a cylinder; a piston which eccentrically rotates along the inner peripheral surface of said cylinder; a vane which is in contact with the outer peripheral surface of said piston, performs reciprocating movement therealong, and defines within said cylinder interior a low pressure chamber and a high pressure chamber; a discharge port to discharge compressed gas outside said cylinder; a discharge valve provided in said discharge port; and an escape groove formed in the inner peripheral wall of said cylinder.

The foregoing objects, other objects as well as the specific construction and operation of the rolling piston type compressor according to the present invention will become more apparent and understandable from the following detailed description thereof, when read in conjunction with the accompanying drawing.

BRIEF DESCRIPTION OF THE DRAWINGS

In the drawing:

FIGS. 3(*c*) and 3(*d*) are respectively perspective views, each showing additional preferred embodiments of the escape groove according to the present invention;

DETAILED DESCRIPTION OF THE PREFERRED EMBODIMENTS

In the following, the present invention will be described in specific details in reference to the accompanying drawing which show preferred embodiments of the present invention.

Figure 1:
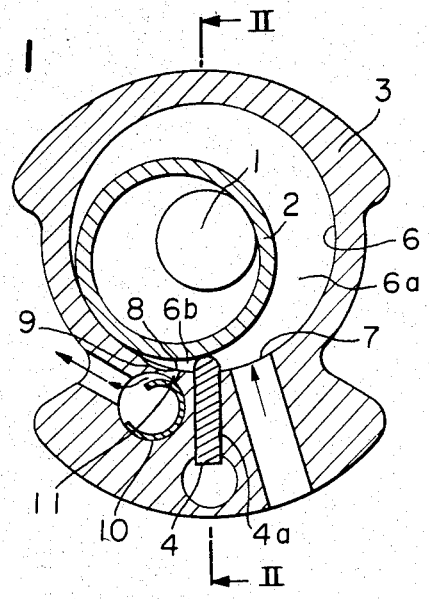
FIG. 1 is a cross-sectional view of a rolling piston type compressor according to one preferred embodiment of the present invention.
Figure 2:
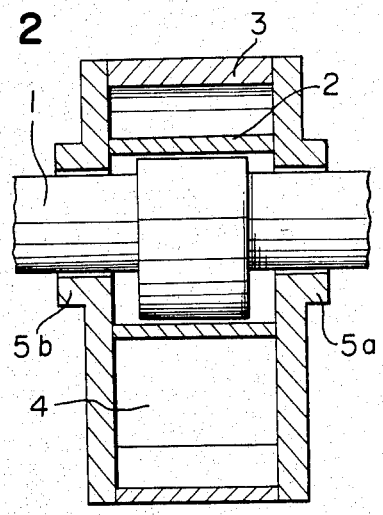
FIG. 2 is a longitudinal cross-sectional view of the compressor shown in FIG. 1 taken along line II—II therein.
Figure 3A:
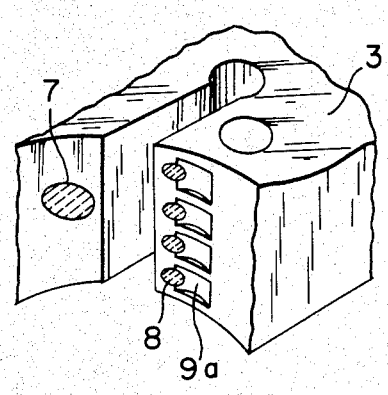
FIGS. 3(*a*) and 3(*b*) are respectively perspective views, each showing preferred embodiments of the escape groove according to the present invention.
Figure 3C:
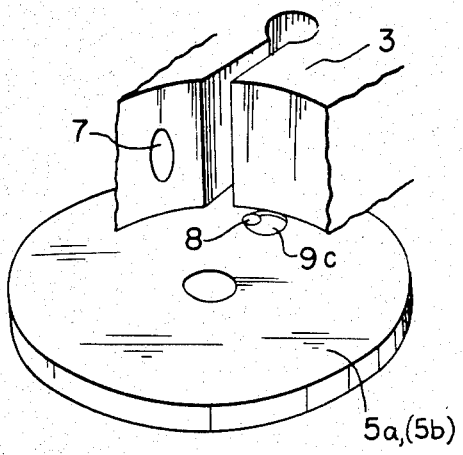
Figure 3B:
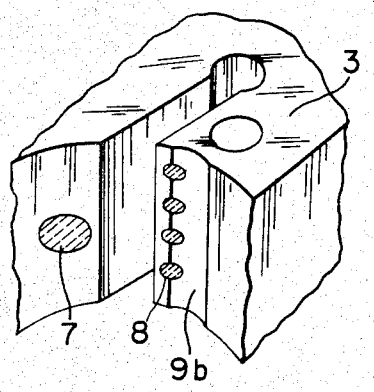
Figure 3D:
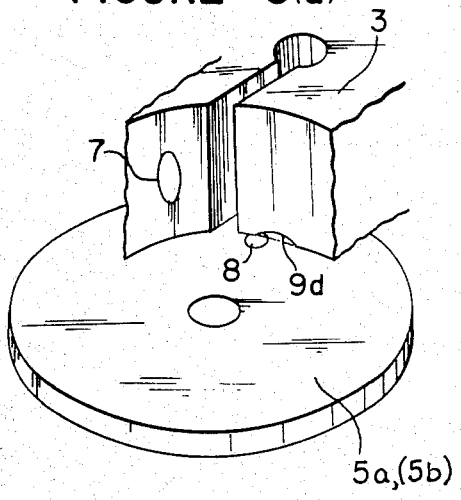

Referring first to FIGS. 1 and 2, reference numeral 1 designates a crank shaft to be rotationally driven by an electric motor, an engine, or similar structure numeral 2 refers to a piston which rotates eccentrically on and along the inner peripheral surface of the cylinder 3 on this crank shaft 1; numeral 4 refers to a vane which moves back and forth in and along a vane groove 4*a* formed in one part of the cylinder 3; 5*a* denotes a main bearing to support the crank shaft 1; 5*b* designates an auxiliary bearing for the crank shaft; reference numeral 6 designates a compression chamber which can be divided by the vane 4 into a low pressure chamber 6*a* and a high pressure chamber 6*b*; numeral 7 refers to an inlet port to permit gas to flow into the compression chamber 6; numeral 8 denotes a discharge port formed in one part of the wall surface of the cylinder 3 for allowing the escape of the compressed gas out of the compression chamber 6; numeral 9 indicates an escape groove which is formed in the inner peripheral surface of the cylinder in a region between the discharge port 8 and the rear side of the rotating piston 2; and 10 refers to a discharge valve provided in the discharge port 8.

In the rolling piston type compressor of the above-described construction, the gas which has been communicated into the low pressure chamber 6*a* through the inlet port 7 is compressed by the rotation of the piston 2 to be gradually rendered a high pressure gas. The high pressure gas in the high pressure chamber 6*b*, when it reaches a pressure level higher than a discharge pressure, is let out of the compression chamber 6 through the discharge valve 10 which is forced to open by the exceeding pressure of the compressed gas. In this compression step, when the piston 2 is about to pass by a point near the discharge port 8, the high pressure gas in the vicinity of the space 11 in the discharge port 8 and the low pressure chamber 6*a* gradually come into communication, the noise caused by the shock wave can be reduced in just the same manner as is the case with the diaphragm of the shock tube being slowly broken.

When the length of the above mentioned escape groove 9 is too long, leakage of the gas from the high pressure chamber 6*b* into the low pressure chamber 6*a* abruptly increases with consequent lowering in the essential performance of the compressor. On the other hand, when the depth of the escape groove is too shallow or deep, the effect to be derived from providing the escape groove is inevitably lowered, hence its depth is required to be determined within the optimum range. As the result of experiments, it has been found that the length of the escape groove 9 should preferably be from 1.5 to 4 times as large as the diameter of the discharge port 8 at the rear side of the rotating piston from the central position of the discharge port, and its depth should be approximately 5% to 25% of the diameter of the discharge port 8, within which range the noise level can be successively reduced without changing the performance of the compressor. Further, the width of the escape groove 9 should preferably be substantially equal to, or more than, the diameter of the discharge port 8 or a corresponding diameter to obtain the above mentioned effect. It is to be farther noted that, as to the extent the depth of the escape groove 9 should be varied with respect to the crank angle, it is preferable that the depth be gradually increased in substantial proportion to the crank angle until the groove 9 is positioned near to the discharge port 8, as will be anticipated from the foregoing explanations. It should, however, be noted that the length and the maximum depth of the escape groove are not critical and, even if the escape groove could not have the change in depth as mentioned above for various reasons in its working, a certain effect can be expected. Furthermore, the change in depth of the escape groove after it has come closer to the discharge port 8 does not substantially influence on the noise level and performance of the compressor, provided that the terminating position of the escape groove is after the center position of the discharge port 8.

FIGS. 3(*a*), 3(*b*), 3(*c*) and 3(*d*) illustrate various embodiments of the escape groove 9. As seen from these illustrations, the escape groove 9*a* is provided at the portion of each discharge port alone as shown in FIG. 3(*a*), or the groove 9*b* may be formed over the entire discharge ports 8 as shown in FIG. 3(*b*). The same function as mentioned above can be obtained by providing the escape groove 9*c* and the discharge port 8 in one part of the main bearing plate 5*a* or the auxiliary bearing plate 5*b*, or by providing the discharge port 8 to the side of the bearing plate 5*a*, 5*b* and the escape groove 9*d* in the wall surface of the cylinder 3, which is contiguous to the discharge port 8.

Figure 4:
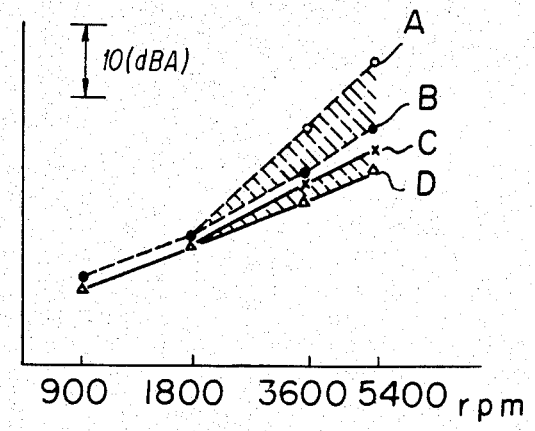
FIG. 4 is a graphical representation showing a relationship between the number of revolutions of the compressor and the noise level thereof.

FIG. 4 is a comparative graphical representation showing the relationship between the noise level and the number of revolutions of the compressor in both a conventional compressor and the embodiment of the present invention. As seen from this graphical representation, the conventional compressor indicates its noise level as indicated by a hatched area A–B, while the present invention indicates a low noise level as enclosed by an area C–D.

Figure 5:
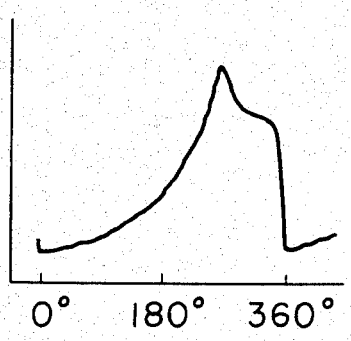
FIGS. 5(*a*) and 5(*b*) are also graphical representations showing pressure waveforms in the high pressure chamber.
Figure 5:
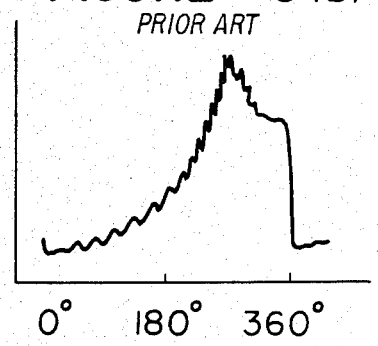
Figure 6:
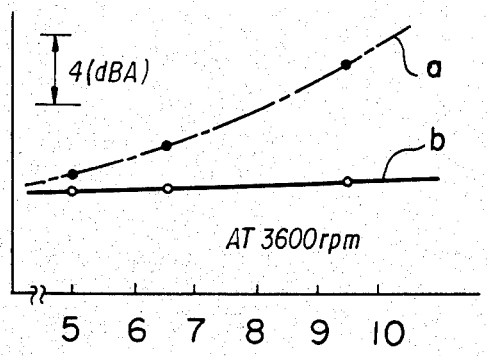
FIG. 6 is a graphical representation showing the relationship between the compression ratio and the noise level of the compressor according to the present invention versus a conventional compressor.

FIGS. 5(*a*) and 5(*b*) illustrate one example of the pressure waveform in the high pressure chamber according to the conventional compressor and a preferred embodiment of the present invention, FIG. 5(*b*) showing the pressure waveform of the conventional compressor. The pressure pulse of the compressor according to the present invention has a decrease of one half or less in regard to the frequency region of 1 KHz and above. Further, FIG. 6 indicates a relationship between the compression ratio and the noise level, from which it is seen that the noise suppression effect becomes conspicuous in the compressor of the present invention (b) in comparison with the conventional compressor (a) as the compression ratio becomes relatively high.

As described in the foregoing, according to the first embodiment of the present invention, the noise to be brought about by the shock wave can be effectively reduced by the provision of the escape groove 9 in the wall surface of the discharge port or in other wall surface contiguous to the former wall surface so as to gradually communicate the high pressure gas in the vicinity of the discharge port and the low pressure chamber of the cylinder.

Next, explanation will be given as to the second embodiment of the present invention, with reference to FIGS. 7 to 9, where the discharge port 8 and the escape groove 9 are provided independently of each other. It should be noted that, in these figures of the drawing, those parts which are the same or equivalent to those in FIG. 2 are designated by the same reference numerals.

Figure 7:
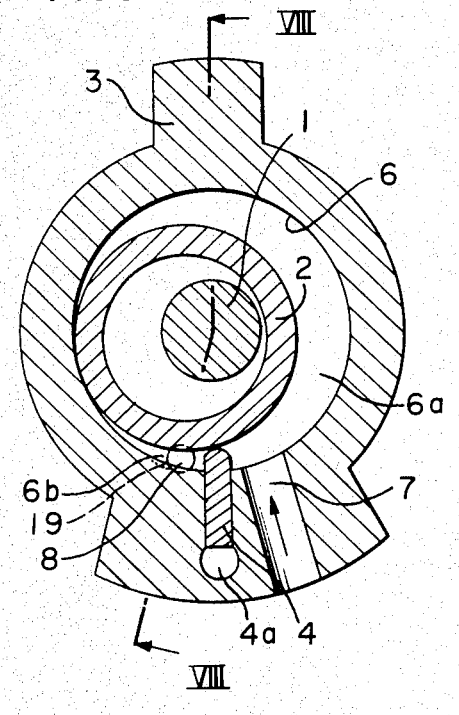
FIG. 7 is a cross-sectional view of the compressor according to a further embodiment of the present invention.
Figure 8:
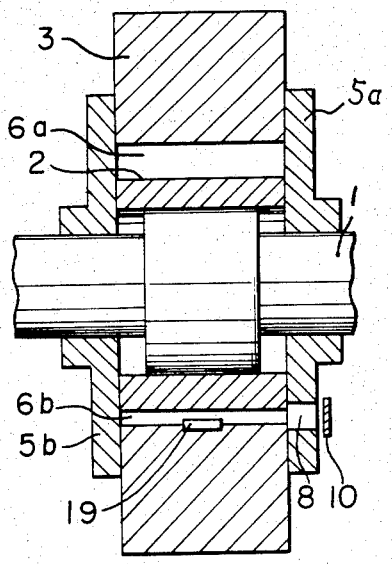
FIG. 8 is a longitudinal cross-sectional view of the compressor shown in FIG. 7 taken along a line VIII—VIII therein.
Figure 9:
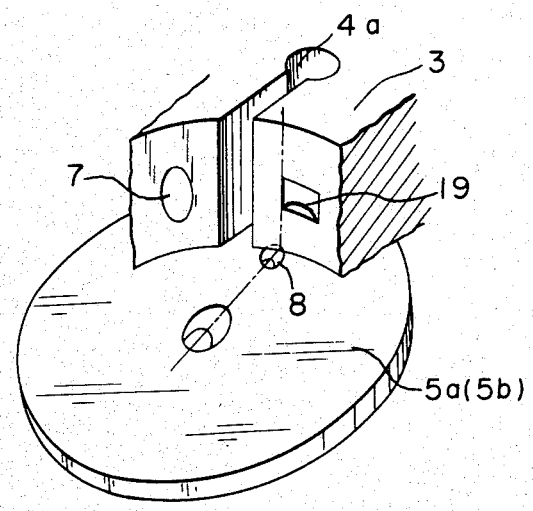
FIG. 9 is a perspective view showing the main part of the compressor shown in FIG. 7.

In this further embodiment of the present invention, the escape groove 19 is formed in the inner peripheral wall of the cylinder 3 at the side of the high pressure chamber 6*b*, as shown in FIGS. 7 to 9. This escape groove 19 extends from the center of the open surface of the gas discharge port 8, and both ends of the groove 19 are set to have a length from 1.5 to 4 times the diameter of the discharge port from the center of the gas discharge port 8.

Further, the maximum depth of the escape groove 19 is set to be from approximately 5 to 25% of the diameter of the gas discharge port 8 or the corresponding diameter, the groove being formed with a gentle gradient in the depth. Incidentally, this escape groove 19 is formed at a position where it does not communicate with the gas discharge port 8. In the drawing, reference numeral 10 designates a discharge valve to open and close the discharge port 8, which is so constructed that it may automatically open when the gas in the cylinder 3 reaches a pressure level higher than the gas discharge pressure.

In the following discussion, an explanation will be given as to the operations of the rolling piston type compressor of the above-described construction. The gas which has flown into the low pressure chamber 6*a* from the gas intake port 7 is compressed by the piston 2 rotating in the cylinder in the counter-clockwise direction to be gradually rendered a high pressure gas. As soon as the gas in the high pressure chamber 6*b* reaches a pressure level higher than the gas discharge pressure, it is let out of the high pressure chamber 6*b*. The escape groove 19 is formed in the high pressure chamber 6*b* as already mentioned in the foregoing discussion, which makes it possible to bring the high pressure chamber 6*b* and the low pressure chamber 6*a* into a mutual communication condition before the piston 2 reaches the center of the discharge port 8. On account of this, the high pressure gas will gradually enter the low pressure chamber 6*a*, the intensity of the shock wave to be produced at that time is suppressed just as is the case with the diaphragm between the high pressure side and the low pressure side of the shock tube being slowly broken.

Incidentally, as to this escape groove 19, if its length in the rotational direction of the piston 2, i.e., the range within which the high pressure chamber 6*b* and the low pressure chamber 6*a* are in communication, is made too long, there takes place an abrupt increase in leakage of the gas from the high pressure chamber 6*b* to the low pressure chamber 6*a* with the result being that the compression performance which is the essential function of the compressor becomes lowered. Further, no effect can be expected even if the escape groove 19 is either too shallow or too deep, and there has been found the optimum range in its depth. Based on these findings, therefore, the shape of the escape groove 19 has been changed in various ways, each configuration being subjected to experimental studies, whereupon the results as mentioned in the foregoing are obtained. It has been made apparent from the above mentioned experimental results that, within the discovered range of the dimension of the escape groove, the undesirable noises could be reduced substantially without invitation of any remarkable decrease in the performance of the compressor as is the case with the firstmentioned embodiment.

It is to be further noted that when the escape groove 19 passes by the center of the gas discharge port 8 and extends in the rotational direction of the piston 2, the change in depth of the groove at a portion where it passes by the center of the discharge port has been found not to substantial influence the noise and performance of the compressor due to shock waves.

As stated in the foregoing, since the escape groove is provided in the cylinder even in this second embodiment of the present invention, the high pressure chamber and the low pressure chamber are in a mutually communicative condition at the time when the piston passes by the gas discharge port, and yet, since the high pressure gas gradually enters into the low pressure chamber, no intense shock wave occurs in the low pressure chamber as in the case of both changes becoming instantaneously communicated, so that its pressure pulse is small and the noise level is suppressed to a satisfactory extent.

We claim:

1. A rolling piston type compressor, comprising:

a cylinder;

a piston eccentrically rotatably mounted along an inner peripheral surface of said cylinder;

a vane mounted in said cylinder and engageable with the outer peripheral surface of said piston for reciprocating movement therealong and defining within said cylinder a low pressure chamber and a high pressure chamber, said cylinder including discharge port means formed entirely therein for discharging compressed gas outside said cylinder; a discharge valve provided in said discharge port means and escape groove means formed in an inner peripheral wall of said cylinder; and means for communicating said escape groove means with said discharge port means wherein said escape groove means has a length which is in a range of 1.5 to 4 times as long as a diameter portion of said discharge port means, has a maximum depth set to be from 5 to 25% of the diameter of said discharge port means and has a width equal to or greater than the diameter of said discharge port means.

2. The rolling piston type compressor according to claim 1, wherein said discharge port means further comprises a plurality of discharge ports formed in said inner peripheral wall of said cylinder and said escape groove means further comprises a plurality of escape grooves communicating to said plurality of discharge ports.

3. The rolling piston type compressor according to claim 1, wherein said escape groove means is formed in a smooth and gradual shape such that, up to the front side of the discharge port means, the cross-sectional area thereof is increased in substantial proportion to the crank angle.

4. The rolling piston type compressor according to claim 1, wherein said escape groove means is disposed at a position independent of said discharge port means.

* * * * *